US007993249B1

(12) United States Patent
Fassl et al.

(10) Patent No.: US 7,993,249 B1
(45) Date of Patent: Aug. 9, 2011

(54) SWING ENHANCEMENT EXERCISE DEVICE WITH RESILIENT RESISTANCE

(76) Inventors: Michael J. Fassl, New Egypt, NJ (US); Robert T. Kaiser, South Hampton, NJ (US)

( * ) Notice: Subject to any disclaimer, the term of this patent is extended or adjusted under 35 U.S.C. 154(b) by 0 days.

(21) Appl. No.: 11/527,065

(22) Filed: Sep. 26, 2006

Related U.S. Application Data

(60) Provisional application No. 60/732,174, filed on Nov. 1, 2005.

(51) Int. Cl.
*A63B 69/34* (2006.01)
*A63B 69/22* (2006.01)
*A63B 69/00* (2006.01)

(52) U.S. Cl. ..... 482/83; 482/86; 482/90; 473/451

(58) Field of Classification Search ..... 482/83–90; 434/247, 251, 252; 473/422, 423, 430, 451, 473/454, 456
See application file for complete search history.

(56) References Cited

U.S. PATENT DOCUMENTS

| | | | | |
|---|---|---|---|---|
| 3,809,397 | A | 5/1974 | Gruenewald | |
| 3,942,796 | A * | 3/1976 | Bowen | 473/441 |
| 4,093,212 | A * | 6/1978 | Jacques | 482/83 |
| 4,564,192 | A * | 1/1986 | Lebowitz | 482/87 |
| 5,554,088 | A * | 9/1996 | Zlojutro | 482/83 |
| 5,711,724 | A | 1/1998 | McGovern | |
| 5,725,458 | A * | 3/1998 | Newman et al. | 482/87 |
| 5,984,842 | A * | 11/1999 | Chu | 482/83 |
| 6,241,640 | B1 * | 6/2001 | Chu | 482/83 |
| 6,309,327 | B1 * | 10/2001 | Hallberg | 482/83 |
| 6,435,937 | B1 * | 8/2002 | Naegele | 446/298 |
| 6,464,622 | B1 * | 10/2002 | Clark | 482/84 |
| 2003/0220177 | A1 * | 11/2003 | Orlando | 482/148 |
| 2005/0014571 | A1 | 1/2005 | Varner | |
| 2007/0082794 | A1 * | 4/2007 | Sams | 482/92 |
| 2010/0222184 | A1 * | 9/2010 | Mannarino | 482/83 |

* cited by examiner

*Primary Examiner* — Loan Thanh
*Assistant Examiner* — Sundhara M Ganesan
(74) *Attorney, Agent, or Firm* — Porzio, Bromberg & Newman, P.C.

(57) ABSTRACT

A training and swing exercise device with resilient resistance is used as a training apparatus for developing greater power and strength at impact when striking a ball. The device provides impact resistance to a golfer, baseball player's, hockey player's, field hockey player's and tennis player's swing in order to develop greater strength and power at ball impact. The striking unit which pivots provides high impact absorption.

1 Claim, 5 Drawing Sheets

SWING ENHANCEMENT EXERCISE DEVICE WITH RESILIENT RESISTANCE

CROSS REFERENCES TO RELATED APPLICATIONS

This application claims the benefit under 35 U.S.C. 119(e) of U.S. Provisional Application Ser. No. 60/732,174, entitled Swing Enhancement Exercise Device With Resilient Resistance, filed on Nov. 1, 2005.

FIELD OF THE INVENTION

This invention relates to exercise devices and more particularly to an exercise device which targets arm swing strength.

BACKGROUND OF THE INVENTION

Today, more and more people engage in various seasonal sports without proper conditioning and training. In activities such as baseball, softball and similar sports which involve striking a ball with strength and accuracy the availability of time to train, to practice and to indulge often must compete with other activities, commitments and obligations. Children as well as their parents desire to do well, even in recreational leagues. An amateur participant or a competitive athlete desires to optimize performance.

A variety of exercise and physical therapy devices exist which can improve a particular motion or muscle group, but they lack the ability to simulate striking a ball while providing resistance to build up strength when swinging and thus condition and train a user conveniently and efficiently. By providing resistance when simulating striking a ball, strength of the strike is improved, thus enabling for a more powerful hit.

Therefore there is a need to provide a simple easy to use device for developing greater power and strength at impact when striking a ball and thus condition and train a user conveniently and efficiently.

SUMMARY OF THE INVENTION

The present invention is a swing exercise device with resilient resistance for developing greater power and strength at impact.

BRIEF DESCRIPTION OF THE DRAWINGS

A more complete understanding of the present invention may be obtained from consideration of the following description in conjunction with the drawings in which.

DETAILED DESCRIPTION OF VARIOUS ILLUSTRATIVE EMBODIMENTS

Figure 1:
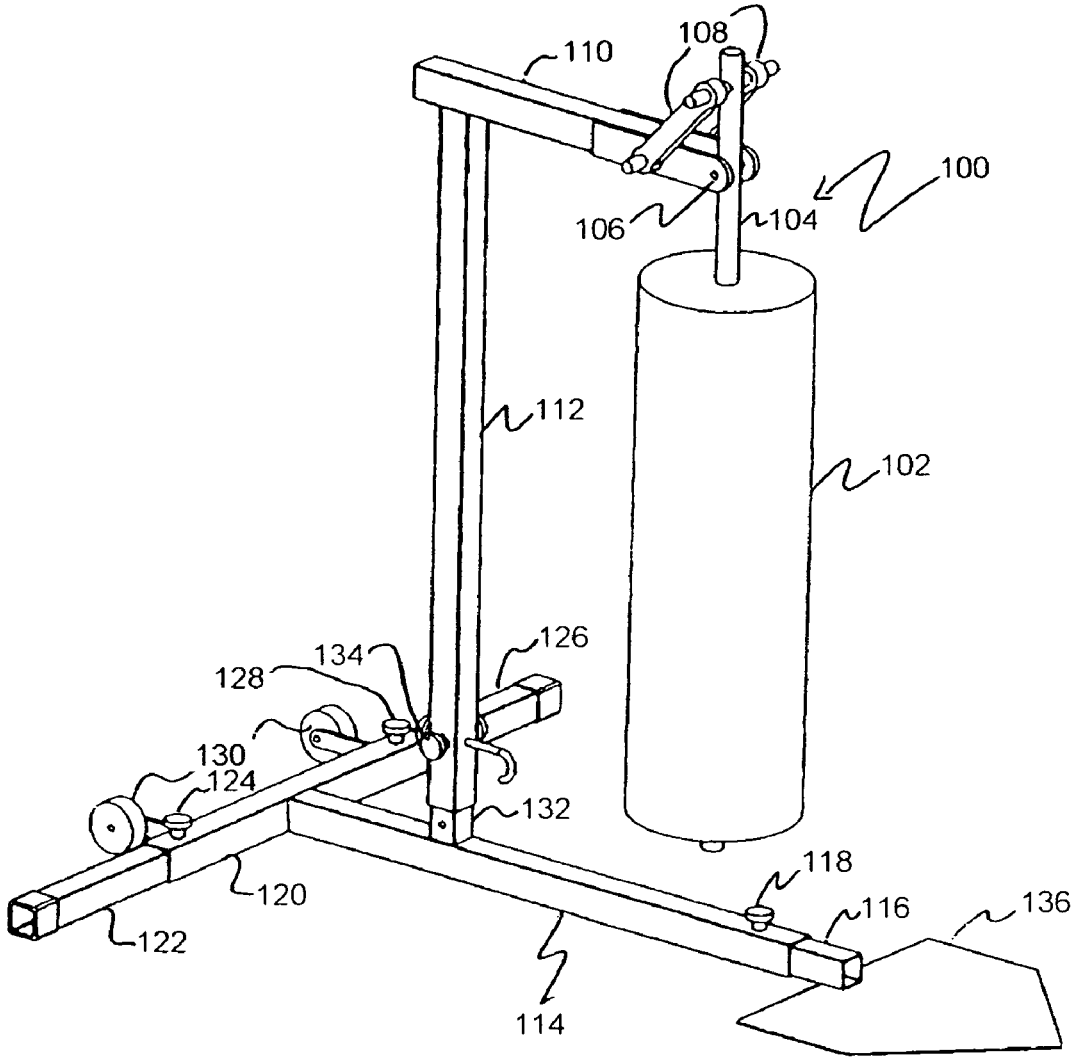
FIG. 1 is a perspective drawing of the swing exercise device with resilient resistance in the static or rest position.

Reference will now be made in greater detail to a preferred embodiment of the invention, an example of which is illustrated in the accompanying drawings. Wherever possible, the same reference numerals will be used throughout the drawings and the description to refer to the same or like parts.

Although the present invention swing exercise device with resilient resistance is particularly well-suited as a training and exercise device for baseball and softball, and is so described herein, it is equally well suited for training and exercise in other sports where a bat, racket, paddle or stick are used to strike a ball, tennis ball, golf ball, hockey puck, field hockey ball, etc.

The present invention swing exercise device with resilient resistance is used as a training apparatus for developing greater power and strength at impact when striking a ball. Moreover, it pertains specifically to such apparatus for developing greater power and strength at impact when striking a ball.

The present invention swing exercise device with resilient resistance provides a training apparatus for developing greater power and strength at impact when striking a ball for developing greater power and strength at impact when striking a ball.

Referring to FIG. 1 there is shown a perspective drawing of the swing exercise device with resilient resistance in the static or rest position. The swing exercise device with resilient resistance 100 has an optional telescoping main support frame two sliding upright sleeves 112 and 132 which are locked into the selected length with locking member 134. The lower sleeve 132 is coupled to a first base member 114 which has an optional telescoping section 116 which are locked into the selected length with locking member 118. A home plate base 136 is removably attached to the optional telescoping section 116, allowing for adjustable positioning of the user. A second base member 120 has two optional telescoping sections 122 and 126 which are locked into the selected length with locking members 124 and 128. Wheels 130 are attached to the second base member 120 to allow for easy and rapid movement and positioning of the swing exercise device with resilient resistance 100. Outrigger arm 110 is coupled to upright sleeve 112 and extends generally parallel with the first base member 114 and optional telescoping section 116.

A striking unit 102, which provides high impact absorption, is attached to a support shaft 104. The support shaft 104 is attached to the outrigger arm 110 by a pivot 106. Resilient elements 108 dynamically couple the support shaft 104 to the outrigger arm 110.

Figure 2:
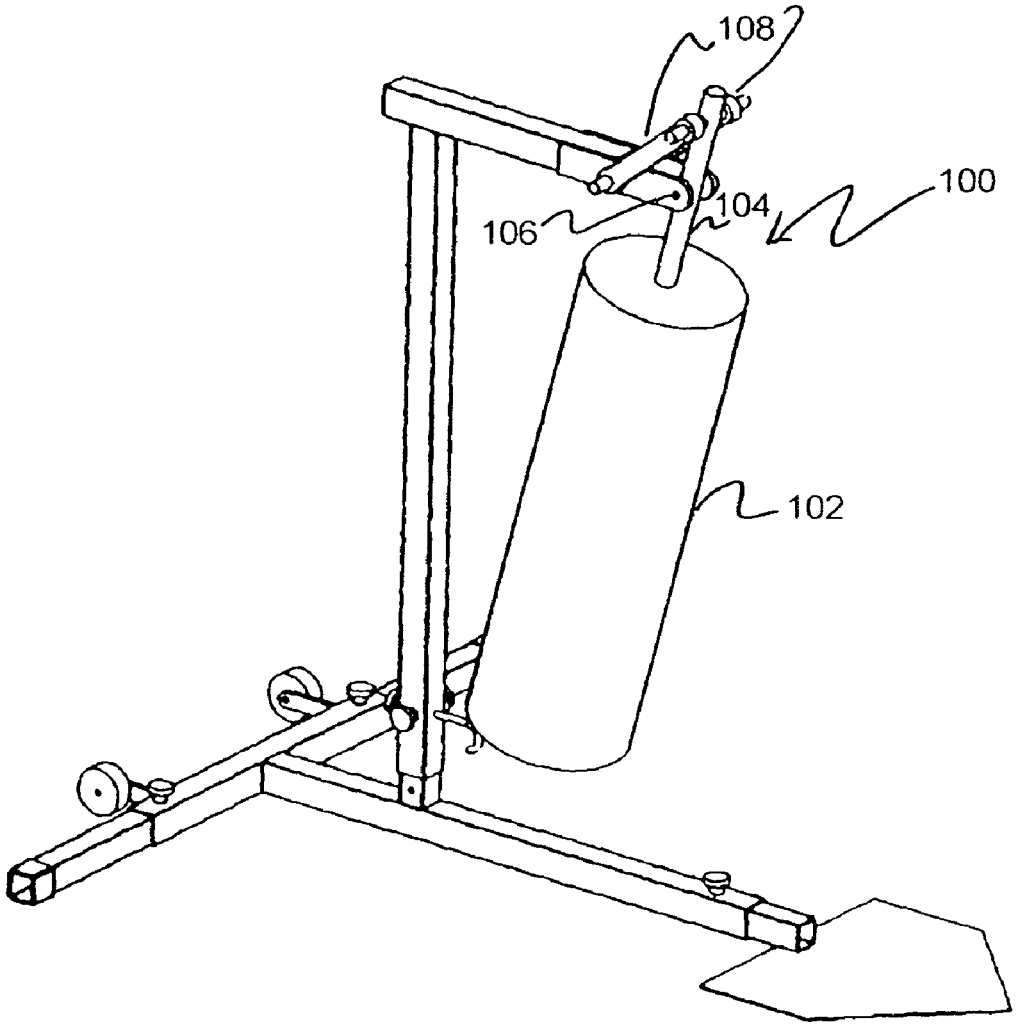
FIG. 2 is a perspective drawing of the swing exercise device with resilient resistance in the dynamic or active position.

Referring to FIG. 2 there is shown a perspective drawing of the swing exercise device with resilient resistance in the dynamic or active position. When a user swings a bat (not shown) at the striking unit 102, the striking unit 102 and the attached support shaft 104 rotate about pivot 106 causing resilient elements 108 to be extended, thus exerting force against the swing which is proportional to the strength of the swing.

Figure 3:
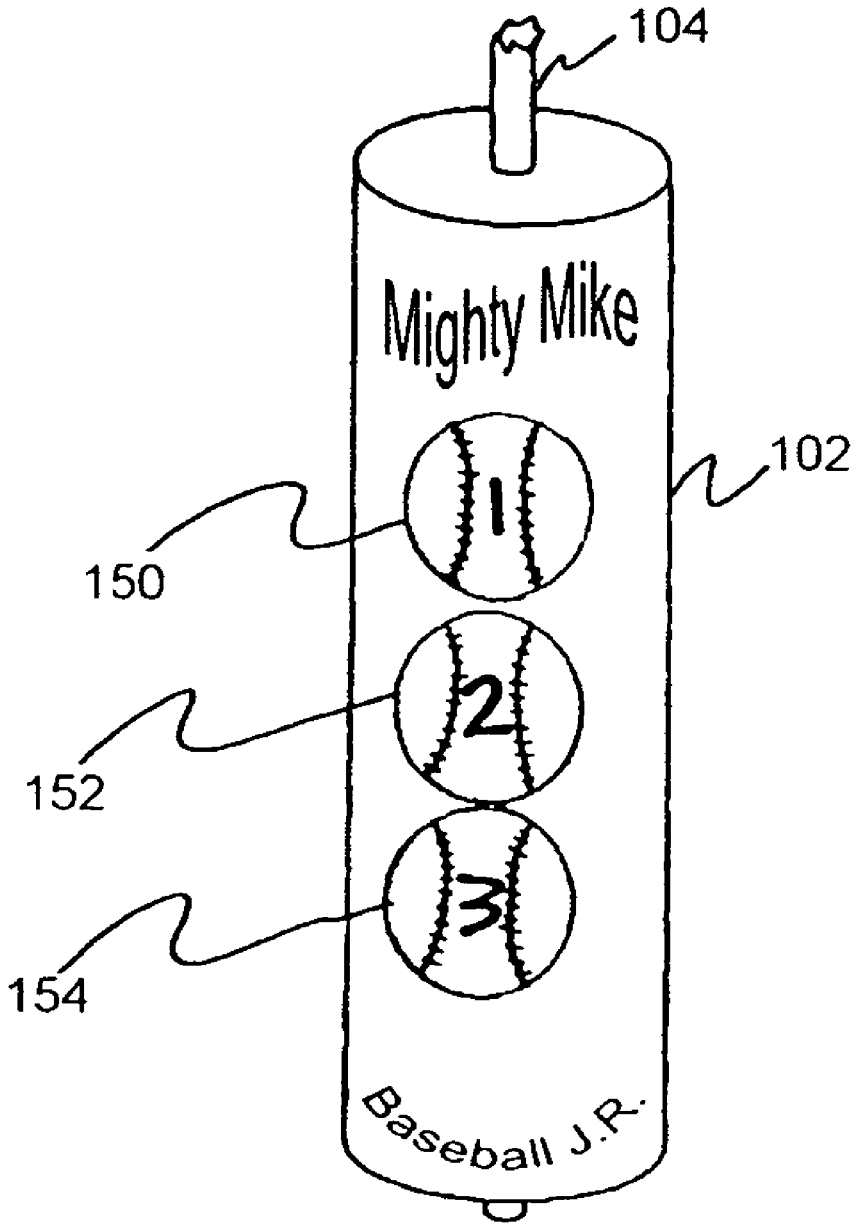
FIG. 3 is a detailed drawing of the impact element of the swing exercise device with resilient resistance.

Referring to FIG. 3 there is shown a detailed drawing of the impact element of the swing exercise device with resilient resistance. Indicia of balls 150, 152 and 154 are positioned on striking unit 102 at various heights. In the case of baseball, they would range over the strike zone area.

Figure 4:
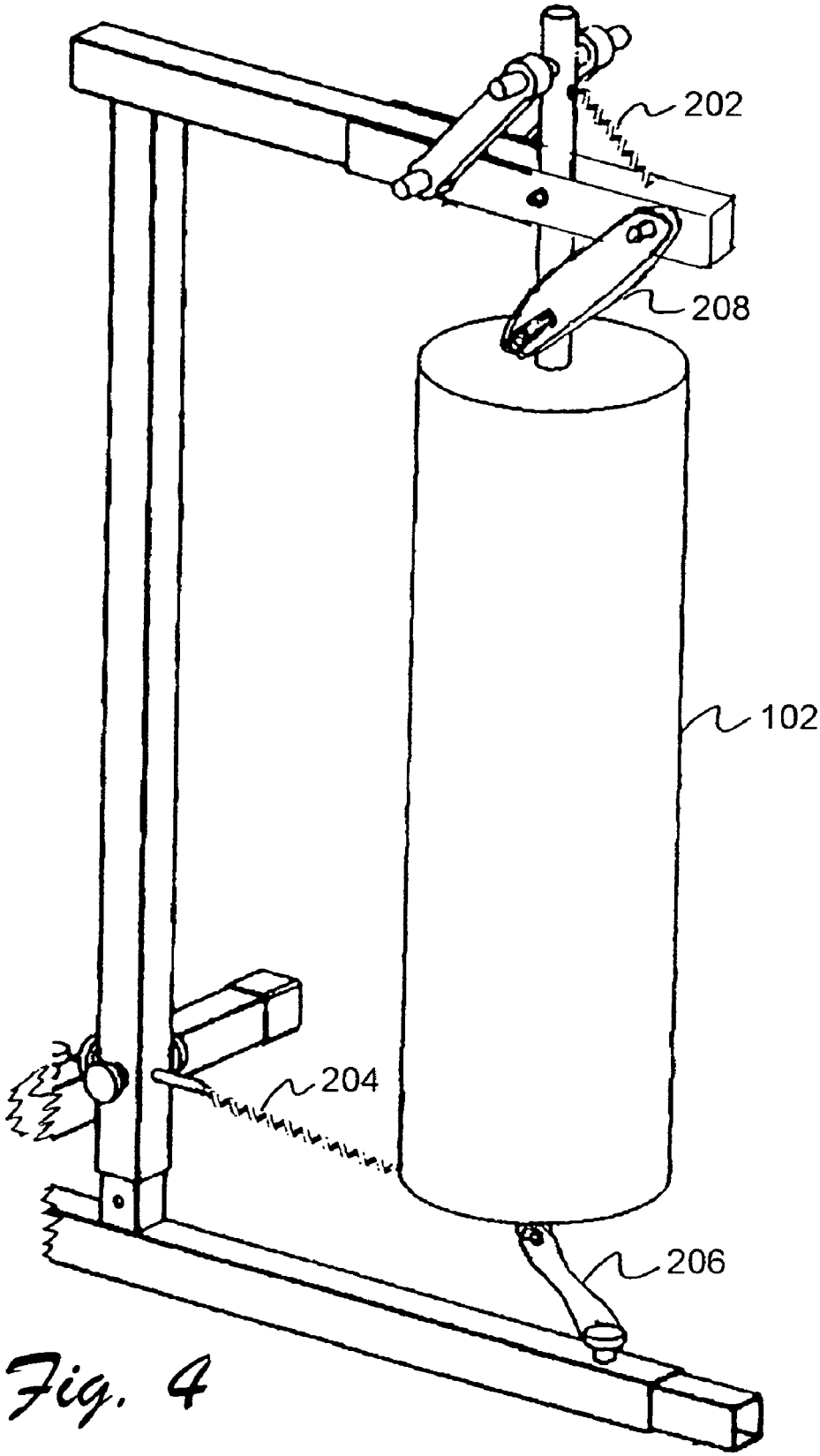
FIG. 4 is a composite perspective drawing of the swing exercise device with resilient resistance in the static or rest position showing various exemplary attachments of resilient elements; and, FIG. 5 is a perspective drawing of another embodiment of the swing exercise device with resilient resistance in the static or rest position.

Referring to FIG. 4 there is shown a composite perspective drawing of the swing exercise device with resilient resistance in the static or rest position showing various exemplary attachments of resilient elements. Additional alternative resilient elements can be used with or in place of resilient elements 208. Alternative resilient elements 202 and 204 are compressive elements. Alternative resilient element 206 and resilient elements 208 are tension elements. The various resilient elements may be elastic elements, simple compression springs, tension springs, a combination of gas struts and springs in parallel, as well as, in series can be used. In addition to coil springs, leaf springs, and other suitable resilient materials can be used. The compression and/or tension springs can also be selected with a simple or a variable progressive spring constant. One type of resilient element that is well suited for use in tension is a rubber tension band. Rubber tension bands are available in various strengths such as 5 lb., 10 lb., 15 lb., etc. The specific selection of the strength of the resilient element is a function of the attachment points, the number of resilient elements used, the type of training and the particular individual using the device. By being able to easily change the resilient element a single training device can be used for a variety of individuals, from a young beginner through an experienced professional. Thus allowing individuals to progressively train as well as accommodate a mix of individual skills and abilities.

Figure 5:
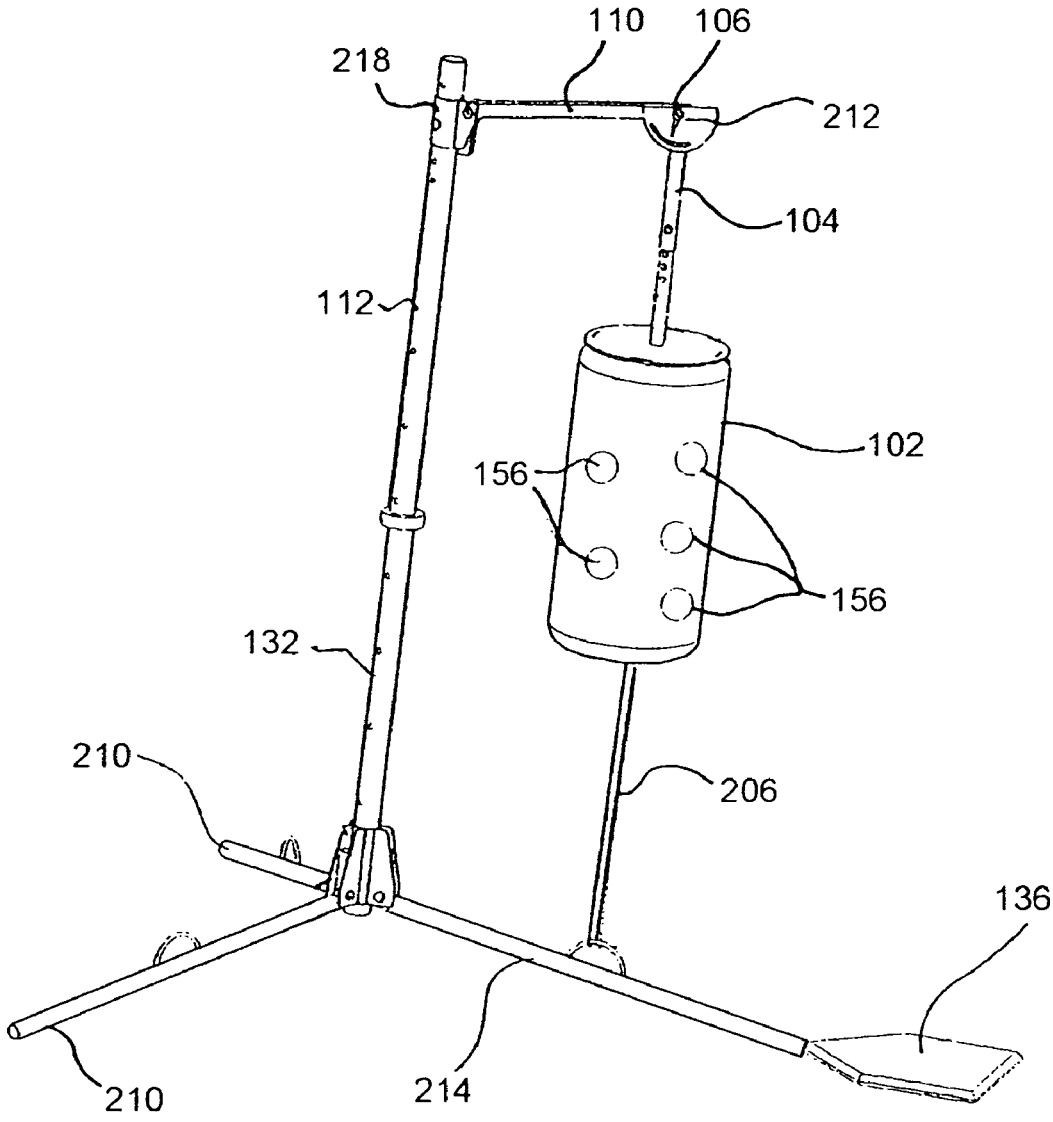

FIG. 5 is a perspective drawing of another embodiment of the swing exercise device with resilient resistance in the static or rest position with a set of optionally telescoping support legs and a folding outrigger arm. The outrigger arm 110 has an integrated force indicator plate, a telescopic pivoting arm 104 and mounting plate to support the striking unit. The support frame is comprised of a telescoping main support frame and two sliding sleeves 112 and 132. The first sliding sleeve 132 has folding legs 210 attached. The second sliding sleeve 112 has a fold out outrigger arm 110 with a force indicator plate. The swinging telescopic support plate pivots in relation to the outrigger arm 110 and provides a flat surface for the top of the striking surface to be mounted to. The sliding sleeves 112 and 132 support the function of the folding legs 210 and folding outrigger arm 110 used to suspend the striking unit 102. The telescoping and pivoting members provide a means of collapsing the device for easy transport.

A striking unit 102 attaches to the telescopic pivoting support plate. The striking unit 102 has a series of targets 156 applied to the striking surface in order to provide various impact locations used to coordinate pre-strike movement patterns. The striking unit 102 also provides a means for attaching a resilient element 206. The apparatus also provides a baseball home plate 136 that telescopes outward providing an ideal striking set up location (stance position) for the user.

Values for the spring constants and strut dampening coefficients may be adjusted specific to the user, sport and level of strength.

A user takes an object representative of a baseball bat, hockey stick, club or racquet and assumes a similar position or stance as normally used in hitting a baseball, golf ball, or tennis ball and swings into one of the target areas located on the strike unit. At contact the strike unit 102 high-energy absorbing material provides a high impact resistance to the object being swung. At impact when the swinging force exceeds the resistive force provided by the striking unit 102 a pivoting action occurs between the striking unit and the outrigger arm. The semi circle shaped dial mounted on the outrigger arm displays the change in the resting angle of the strike unit and the angle created by the sudden impact of the object being swung. The greater the impact, the greater the angle change. With each impact the muscle and tendon reflexes are activated at higher than normal levels. The repetition of elevated muscle and tendon activity builds greater strength, impact capability and greater joint stability at impact and results in balls, respective of their sport, traveling faster and further with greater repeatability.

In addition to being used for developing greater power and strength at impact when striking a ball device, the swing exercise device with resilient resistance can be used to develop better coordination resulting from hitting designated target areas on the striking surface repeatedly.

The swing exercise device with resilient resistance is a training device that provides impact resistance to a golfer, baseball, hockey, field hockey or tennis player's swing in order to develop greater strength and power at ball impact.

The swing exercise device with resilient resistance optionally provides a means of measuring the impact force and the accuracy of the strike. Optionally a bat speed gauge measures bat speed, meter for how many times a ball is hit in the strike zone. Automatic strike zones are powered to move up and down based on the height of the batter, automatic resistance meter tells you how much resistance is needed to strengthen the batter. The indicia can be comprised of adjustable balls for specific bat training for inside, outside, low and high pitches within your strike zone.

The swing exercise device with resilient resistance is designed to increase batting strength when striking the ball and enhances eye coordination by having balls on the bag the same size as a regular ball, and is designed to make contact at the same location as receiving a pitched ball.

The strike zone has give (is cushioned and dampened) to avoid impact injury to your joints when working out. In one exemplary embodiment of the present invention, the striking unit 102 is a sewn canvas bag with carpet padding inside. The indicia of balls can be heat transfers, silk screened as well as may be applied by other methods. Other forms of impact absorbing materials can be used, which are known to those skilled in the art. The firmness and dampening effect of the impact absorbing materials can be adjusted for various uses including different sport training as well as the age and strength of the user.

The home plate creates a batter-box work out so when striking the bag you are within the batter box. The home plate is adjustable for baseball or softball.

The resistance is adjustable based on an individual's need for strengthening or desire to maintain a current strength; increasing the resistance as needed to strengthen the batter. The height of the striking surface can be raised or lowered.

When using the swing exercise device with resilient resistance for developing greater power and strength at impact when striking a ball, in order to properly condition and train a user conveniently and efficiently, a series of workouts over a period of time are necessary. The following is an exemplary set of workout instructions for baseball:

- Set up the stand as per assembly guide/safety & assembly.
- Attach bag to stand then attach tension bands using the 51b. bands one on each side. Never use different size tension bands, both sides must be the same size and tension.
- Adjust the height of the stand to simulate your strike zone.
- You will need to have 2 bats: one your regular size, one t-ball size (25" to 27").
- You will need at least 30 minutes to complete the daily work out.
- It is recommended to wear all appropriate safety gear during work out.
- First time users should use caution when striking the bag, (if not holding the bat properly) the impact of striking the bag could cause the bat to come out of your hand or bounce back and hit you.
- Stand in your normal batting stance holding your regular bat as you normally would when hitting a ball (using your normal bat would be fine, if using a heavier bat it is recommended prior to starting your pre-season work out, you change to your regular bat to avoid throwing off your bat speed).

Begin your work out by keeping your eye on the ball you are going to hit.

Follow through and hit the ball you selected (very important for enhancing eye hand coordination and accuracy when batting).

Swing your bat as usual striking the bag at the image of the ball you are hitting.

Step away from the stand.

Adjust your batting stance if needed to hit the ball.

Repeat until you are comfortable with your stance and the image of the ball you are hitting.

Choose a different ball and repeat until you have hit all balls at least 10 times.

Next: holding a 25" to 27" bat begin striking the bag using only your right arm. This requires concentration on the bag and ball and will play a major part in your strength training.

You should do this one after the other 10 times each with a break and repeating for a total of 3 times.

Take a 5 minute break.

Next: holding a 25" to 27" bat begin striking the bag using only your left arm only. This requires concentration on the bag and ball and will play a major part in your strength training.

You should do this one after the other 10 times each with a break and repeating for a total of 3 times.

Take a 5 minute break.

Next you should go back to your regular batting stance with your regular bat and repeat hitting the balls this time five times each. You should notice a difference in strength when striking the bag at this time.

Also you will notice you will not be able to pull or turn your head away while batting (you need to watch the ball in order to hit it) this will become natural as you continue your work out.

You have now completed your work out. At this time it is recommended you jog for at least 10 minutes.

You should continue this work out routine everyday for 5 days, and then take 2 days off.

Repeat your routine for another 5 days. After completion go to a batting cage or have some one pitch to you. Enjoy the increase in strength and accuracy.

This should then become a regular part of your training and should continue at least three times a week during your pre-season and season.

This should then become a regular part of your training and should continue at least 3 times a week during your pre-season and regular season.

As you become stronger, meaning if you are striking the bag and it is going more than half way to the stand, it is time to increase the tension bands to a stronger resistance to increase batting strength. You should add an additional 5 lb. tension band on each side, increasing the tension in 10 lbs. intervals only, to avoid injury. Each increase should be followed by the 5-day work out for 2 weeks, then going to 3 times a week.

The following table provides an exemplary work out schedule for week one:

| Day One | Day Two | Day Three | Day Four | Day Five |
|---|---|---|---|---|
| 10 times each ball. Regular batting stance 10 times each ball, right arm, 3 sets 10 times each ball, left arm, 3 sets 10 times each Weak arm Remember to take a short break between sets 5 times each ball with regular batting stance Jog 10 min. How did you feel the work out benefited you? | 10 times each ball. Regular batting stance 10 times each ball, right arm, 3 sets 10 times each ball, left arm, 3 sets 10 times each Weak arm Remember to take a short break between sets 5 times each ball with regular batting stance Jog 10 min. How do you feel physically? | 10 times each ball. Regular batting stance 10 times each ball, right arm, 3 sets 10 times each ball, left arm, 3 sets 10 times each Weak arm Remember to take a short break between sets 5 times each ball with regular batting stance Jog 10 min. Are you feeling stronger? | 10 times each ball. Regular batting stance 10 times each ball, right arm, 3 sets 10 times each ball, left arm, 3 sets 10 times each Weak arm Remember to take a short break between sets 5 times each ball with regular batting stance Jog 10 min. How do you feel physically? | 10 times each ball. Regular batting stance 10 times each ball, right arm, 3 sets 10 times each ball, left arm, 3 sets 10 times each Weak arm Remember to take a short break between sets 5 times each ball with regular batting stance Jog 10 min. How do feel the work out is progressing? |

The following is an exemplary set of workout instructions for children for baseball:

Set up the stand as per assembly guide/safety & assembly.

Attach bag to stand then attach tension bands using the 51b. bands one on each side. Never use different size tension bands both sides must be the same size and tension.

Adjust the height of the stand to simulate the child's strike zone.

Your child will need at least 30 minutes to complete the work out.

It is recommended that the child wear all appropriate safety gear during their work out.

First time users should use caution when striking the bag, (if not holding the bat properly) the impact of striking the bag could cause the bat to come out of the child's hand or bounce back and hit the child.

Have the child stand in their normal batting stance/holding their regular bat as they normally would when hitting a ball.

Begin the work out by having the child pick out the ball they are going to hit (very important for enhancing eye hand coordination and accuracy when batting).

Now have the child swing their bat as usual striking the bag at the ball they are hitting.

Step away from the stand.

Adjust the batting stance if needed to hit the ball.

Repeat until the child is comfortable with their stance and the ball they are hitting.

Choose a different ball and repeat until you have hit all balls at least 5 times, 10 times for 9 years and older (for smaller children it is recommended to hit the middle ball only repeating for 3-5 times).

You will notice that the child will not be able to pull/turn their head away while batting (they need to watch the ball in order to hit it). This will become natural as they continue their work out.

They should continue this work out routine everyday for 5 days, and then take 2 days off.

Repeat the routine for another 5 days. After completion go to a batting cage or pitch to the child. Enjoy the increase in strength and accuracy.

The following is an exemplary set of advanced workout instructions for children nine and older for baseball:

Next: holding a 25" bat in the right arm begin striking the bag using the right arm only, this requires concentration on the bag and ball and will play a major part in their strength training.

They should do this one after the other 10 times each with a break and repeating for a total of 2 times.

Next: holding a 25" bat in the left arm begin striking the bag using their left arm only, this requires concentration on the bag and ball and will play a major part in their strength training.

They should do this one after the other 10 times each with a break and repeating for a total of 2 times.

Next they should go back to their regular batting stance/with their regular bat and repeat hitting the balls this time five times each. (They should notice a difference in strength when striking the bag at this time.) During this time the adult may start calling out which balls for the child to hit. To do this make sure the child is set to hit the bag, just before swinging, call a ball (number 1, 2 or 3 etc.).

Notice that they will not be able to pull/turn their head away while batting (they need to watch the ball in order to hit it), this will become natural as they continue their work out.

They have now completed their work out. At this time it is recommended that they jog for at least 10 minutes.

They should continue this work out routine everyday for 5 days, and then take 2 days off.

Repeat the routine for another 5 days. After completion go to a batting cage or have some one pitch to them. Enjoy the increase in strength and accuracy.

This should then become a regular part of their training and should continue at least three times a week during their pre-season and season.

Numerous modifications and alternative embodiments of the invention will be apparent to those skilled in the art in view of the foregoing description. The pivot attachment can be replaced with a ball and socket attachment for a greater range of motion. Accordingly, this description is to be construed as illustrative only and is for the purpose of teaching those skilled in the art the best mode of carrying out the invention. Details of the structure may be varied substantially without departing from the spirit of the invention and the exclusive use of all modifications, which come within the scope of the appended claims, is reserved.

What is claimed is:

1. A swing exercise device for developing greater power and strength at impact when striking a ball with a bat and thus condition and train a user's swing comprising:

a support frame having a base and an outrigger arm;

a strike element suspended by a support shaft from the outrigger arm, the strike element having a padded energy absorbing surface;

the support shaft is attached to the outrigger arm by a pivot, the strike element is pivotally suspended by the support shaft from the outrigger arm;

at least one resilient element coupled between the outrigger arm of the support frame and the support shaft;

the strike element including indicia of balls at various heights marking desired range of impact areas; and a removably attached home plate, wherein the home plate is attached to the support frame with a telescoping section, wherein the user swings and impacts the strike element and the support shaft rotates about the pivot causing the resilient element to be extended for exerting force against the swing which is proportional to the strength of the swing;

whereby the impact is dampened by the padded energy absorbing surface and movement of the suspended strike element is resisted by the at least one resilient element.

* * * * *